US006270033B1

(12) United States Patent
Haasen et al.

(10) Patent No.: US 6,270,033 B1
(45) Date of Patent: Aug. 7, 2001

(54) METHOD FOR OPERATING A WORK STATION OF A BOBBIN WINDING MACHINE

(75) Inventors: Rolf Haasen, Mönchengladbach; Hans Günter Wedershoven, Neetetal; Bernd-Rüdiger Theele, Aachen, all of (DE)

(73) Assignee: W. Schlafhorst AG & CO. (DE)

( * ) Notice: Subject to any disclaimer, the term of this patent is extended or adjusted under 35 U.S.C. 154(b) by 0 days.

(21) Appl. No.: 09/425,546

(22) Filed: Oct. 22, 1999

(30) Foreign Application Priority Data

Oct. 23, 1998 (DE) ..... 198 48 881

(51) Int. Cl.[7] ..... B65H 49/06; B65H 54/22
(52) U.S. Cl. ..... 242/474.1
(58) Field of Search ..... 242/474, 474.1, 242/474.2, 419.4, 150 M

(56) References Cited

U.S. PATENT DOCUMENTS

| | | | | |
|---|---|---|---|---|
| 4,844,358 | * | 7/1989 | Kamp | 242/474 X |
| 5,000,231 | * | 3/1991 | Takehana et al. | 242/474.2 X |
| 5,022,596 | * | 6/1991 | Wey et al. | 242/474 |
| 5,269,478 | * | 12/1993 | Wakabayashi et al. | 242/474.1 X |

FOREIGN PATENT DOCUMENTS

| | | |
|---|---|---|
| 37 18 924 A1 | 12/1987 | (DE) . |
| 40 04 755 A1 | 8/1990 | (DE) . |
| 41 29 803 A1 | 3/1993 | (DE) . |
| 39 23 333 C2 | 4/1993 | (DE) . |
| 196 50 932 A1 | 6/1998 | (DE) . |
| 08040643 | 2/1996 | (JP) . |

* cited by examiner

*Primary Examiner*—Michael R. Mansen
(74) *Attorney, Agent, or Firm*—Kennedy Covington Lobdell & Hickman, LLP

(57) ABSTRACT

A method for operating the winding heads of a bobbin winding machine each of which respectively has a yarn tension sensor connected to a work station computer for detecting the actual tension in a yarn traveling from a delivery bobbin to a take-up bobbin, a yarn tensioner for regulating the yarn tension, a splicing device for automatic connection of yarn ends following a yarn break and/or a yarn cleaning cut, and a delivery bobbin changing device. After a splicing of the broken or cut yarn ends, the actual yarn tension is detected by the yarn tension sensor, and the detected value is compared in the work station computer with a threshold value which, if exceeded, results in actuation of the delivery bobbin changing device to provide a fresh delivery bobbin.

11 Claims, 1 Drawing Sheet

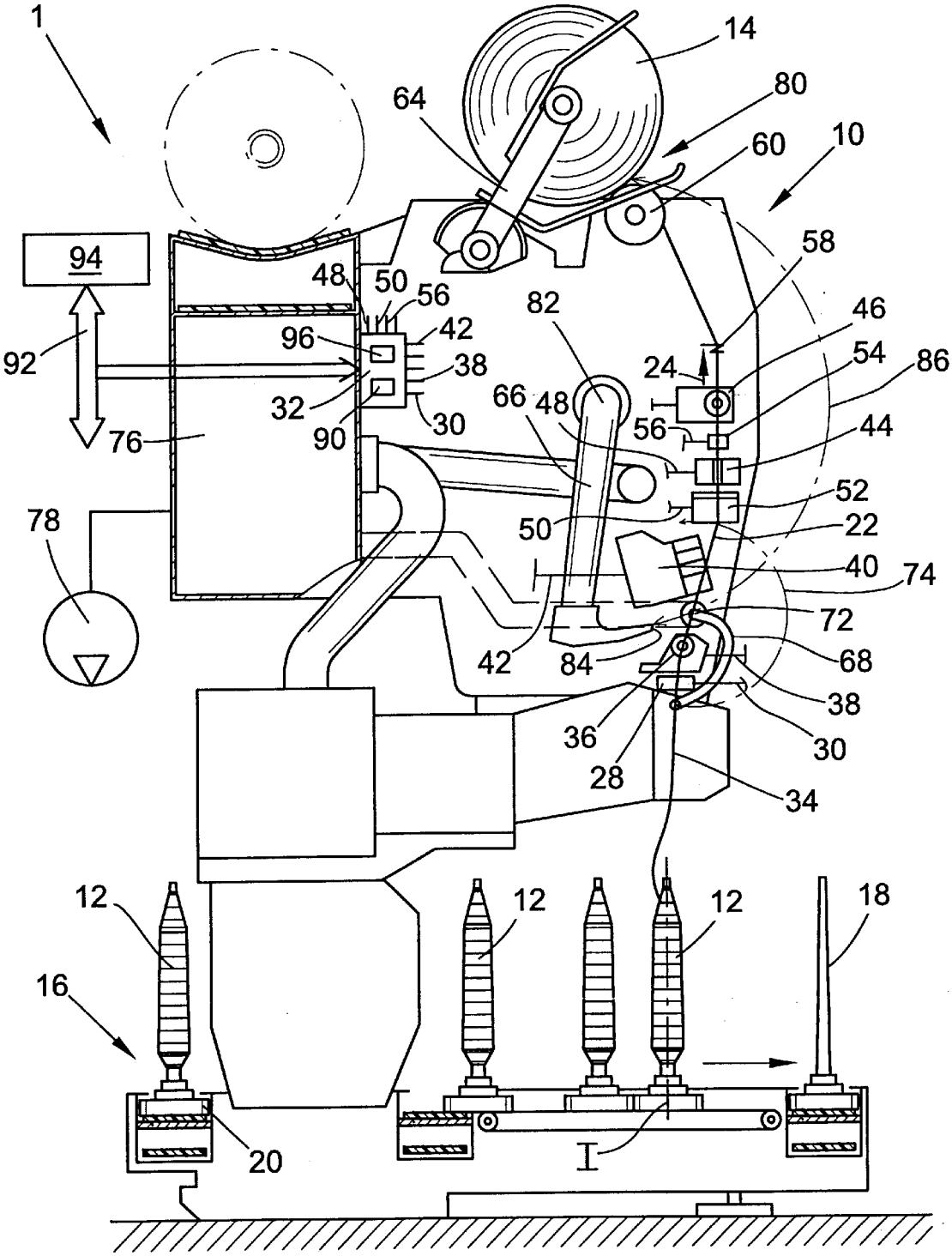
1
14
80
64
60
10
94
58
48
50
56
82
46
96
42
92
38
24
54
86
66
48
32
30
56
44
76
90
52
78
50
22
40
74
72
42
84
68
38
36
30
28
34
12
12
12
18
16
20
I

METHOD FOR OPERATING A WORK STATION OF A BOBBIN WINDING MACHINE

FIELD OF THE INVENTION

The invention relates generally to a method for operating a work station of a bobbin winding machine, typically for rewinding a yarn from a delivery bobbin onto a take-up bobbin. More particularly, the invention relates to such a method wherein the bobbin winding machine has a yarn tension sensor connected to a control device for monitoring the tension of the yarn traveling from the delivery bobbin to the take-up bobbin, a yarn tensioner for regulating the yarn tension, a splicing device for the automatic connection of the yarn end of the delivery bobbin (bottom yarn) with the yarn end of the take-up bobbin (top yarn) following a yarn break or a yarn cleaning cut, and a bobbin exchange device for exchanging delivery bobbins which cannot be further unwound.

BACKGROUND OF THE INVENTION

A bobbin winding machine designed as a cheese-producing textile machine is known, for example, from German Patent Publication DE 196 50 932 A1. Such so-called automatic cheese winders have a plurality of work stations designed as winding heads, which are usually arranged next to each other in the longitudinal extent of the bobbin winding machine. It is known to assign a separate work station computer to each winding head for operating, monitoring and controlling the bobbin winding machine. In this case, the individual work station computers are connected via a machine bus with a central control unit of the bobbin winding machine.

As a rule, such automatic cheese winders have a logistic device in the form of a bobbin and tube transport system. Delivery bobbins, e.g., so-called spinning cops, or respectively empty cop tubes circulate, standing upright on the arbors of transport disks, travel on this bobbin and tube transport system.

Such bobbin winding machines also have a service unit in the form of a cheese changer, which automatically services the work stations. The cheese changer transfers finished take-up bobbins from the creel of the work station to a transport device which extends the length of the machine to convey the cheeses to a transfer station arranged at the end of the machine. The service unit subsequently inserts a fresh empty tube into the creel of the respective work station.

During the rewinding of the yarn from a delivery bobbin to a take-up bobbin, it is known to monitor the running yarn, e.g., by means of a yarn tension sensor, and to keep the yarn tension at a predetermined level by means of a yarn tensioner. This means that an essentially constant yarn tension is set by means of the yarn tensioner in order to assure the uniform winding of the yarn on the take-up bobbin in this manner.

It is known from German Patent Publication DE 41 29 803 A1 to detect the actual yarn tension of the running yarn by means of a yarn tension sensor. A control signal for the yarn tensioner is made available by means of a yarn tension measurement performed by this yarn tension sensor on the running yarn which, in accordance with the control signal, then exerts a more or less large braking effect on the running yarn. In this manner, it is assured that the yarn is wound at a defined tension on the take-up bobbin.

It is furthermore known in the course of the rewinding process to guide the running yarn through a so-called yarn cleaner. This yarn cleaner traces the running yarn to detect irregularities, for example thickened or thin places. If such irregularities are detected, a yarn cut is triggered by the yarn cleaner. In the process the running yarn is cut below the faulty place, creating two cut yarn ends which may be referred to as a bottom yarn and a top yarn. The top yarn having the faulty place initially runs up on the cheese, since the latter cannot be abruptly braked to a stop because of its relatively great centrifugal mass.

With a controlled yarn cleaning cut, the bottom yarn is usually held in the yarn tensioner and can be transferred by means of a so-called gripper tube into a splicing device, wherein the end of the bottom yarn is connected with the end of the top yarn, which is retrieved from the cheese surface by means of a pivotably seated suction nozzle.

It is moreover known to equip the bobbin winding machines with a so-called bottom yarn sensor, which detects the presence of the bottom yarn, since the presence of the bottom yarn is absolutely necessary for the successful performance of a yarn connection.

As already explained above, in the course of an intended yarn cut because of a detected irregularity in the yarn, the bottom yarn as a rule is held by the yarn tensioner so that the bottom yarn sensor thereof, which is arranged upstream as viewed in the traveling direction of the yarn, can detect the presence of a bottom yarn.

However, operational states can also occur in the course of the operation of the bobbin winding machine which are caused by a yarn break or the exhaustion of the delivery bobbin, for example. In case of a yarn break, a search for the top yarn and the bottom yarn is performed by the splicing device, and they are automatically reconnected with each other analogously to the connection of the bottom yarn and the top yarn in case of an intended yarn cut. If the delivery bobbin has run out, or if the yarn breaks below the yarn tensioner, the absence of a bottom yarn in detected by the bottom yarn sensor. In such a case, a delivery bobbin changing device is automatically activated by the work station computer of the winding head, which makes sure that the empty cop tube or the spinning cop (as the case may be), which can no longer be unwound because of the lack of a bottom yarn, is exchanged for a fresh delivery bobbin.

It is also possible for hook formations of the yarn and/or loop formations to occur at the delivery bobbin, in particular in connection with a yarn break above the yarn tensioner. As a result, although the bottom yarn sensor detects the presence of a bottom yarn, these hooked yarns or loops can prevent the respective winding head from operating automatically in spite of several repetitions of the yarn connecting process.

In case of a hooked yarn and/or loop formation at the delivery bobbin, a yarn break will immediately occur again after the restart of the winding head. In this connection, it is disadvantageous, among other things, that a loss of time occurs because of the repeated connecting and breaking of the yarn, which results in a loss of productivity of the respective winding head.

OBJECT AND SUMMARY OF THE INVENTION

It is accordingly an object of the present invention to provide a method of operating a bobbin winding machine of the type described above, by means of which the productivity of the work stations, i.e., the winding heads, is increased.

Basically, the present invention concerns a method for operating a work station of a bobbin winding machine wherein a yarn is rewound from a delivery bobbin onto a take-up bobbin, wherein the bobbin winding machine utilizes a yarn tension sensor connected to a control device for monitoring the tension of the yarn traveling from the delivery bobbin to the take-up bobbin, a yarn tensioner for regulating the yarn tension, a splicing device for the automatic connection of the yarn end of the delivery bobbin (bottom yarn) with the yarn end of the take-up bobbin (top yarn) following a yarn break or a yarn cleaning cut, and a bobbin exchange device for exchanging delivery bobbins which cannot be further unwound.

In accordance with the invention, the intended objective is attained by a method wherein the yarn tension is tested by the yarn tension sensor, for example after the connection of the top yarn with the bottom yarn has been performed following a yarn break, to determine whether the actual tension value lies above a predeterminable set value for the yarn tension making it possible to directly detect whether a threshold value has been exceeded indicating an error which cannot be automatically repaired, whereby the change of the delivery bobbin can be immediately initiated. Thus, if the actual value measured by the yarn tension sensor exceeds the predeterminable threshold value, it is possible to draw the conclusion that the yarn is hooked, for example, on the delivery bobbin, has formed a loop, or is otherwise subject to a retaining force acting on the yarn in the opposite direction of the force of yarn withdrawal from the delivery bobbin which can be predicted to lead to a renewed yarn break. It is therefore obvious that every further attempt to connect the bottom yarn with the top yarn would be unsuccessful, because a yarn break will again occur thereafter. The correction of this trouble is only possible by exchanging the delivery bobbin. Because this can be immediately detected, it is possible to trigger an appropriate signal via a work station computer of the winding head, so that the delivery bobbin exchange is directly initiated.

The productivity of this winding head is therefore increased, since the time for the repeated locating (via aspiration) of the top yarn on the take-up bobbin and the time for the repeated connection of the bottom yarn and the top yarn, as well as the renewed detection of the yarn break, can be avoided and saved. Avoiding repeated yarn connecting attempts which are useless from the start furthermore has a positive effect on the quality of the wound take-up bobbin, since at each yarn connecting attempt the suction nozzle is pivoted onto the cheese surface for picking up the top yarn, which leads to a loosening of the already wound-up yarn layers.

In a preferred embodiment of the invention, it is provided that the predeterminable threshold value, which is compared with the actual value, is stored in a memory unit of the work station computer. It is particularly preferred if this preset value is mutually predetermined for all winding heads of at least one bobbin winding machine by a central computer unit. In this manner, it is possible in a simple manner to variably preset the set value as a function of the yarn to be rewound, for example in relation to its strength properties, material strength and the like. Thus, the predeterminable set values can be changed in respect to the actually wound yarn. This results in a very universal use of the method of the invention. It is furthermore provided in a preferred embodiment of the invention that the predeterminable threshold value can be changed during the operation of the winding head as a function of the operating parameters of the winding head. In this manner, it is possible to optimally adapt the set values to the actual conditions, for example as a function of an amount of yarn already unwound from the delivery bobbin, or changes in the ambient temperature which, for example, have an effect on the tear resistance of the yarn to be wound. To this extent it is possible to assuredly detect by means of the method of the invention whether an occurring yarn break actually is an unrepairable hook or loop formation of the yarn or the like.

Further aspects, advantages, features and preferred embodiments of the invention will be explained and understood in greater detail in the following disclosure of an exemplary embodiment, with reference to the associated drawings.

DETAILED DESCRIPTION OF THE DRAWING

The sole drawing FIGURE represents a schematic lateral elevational view of a winding head of a winding machine in accordance with a preferred embodiment of the present invention.

DETAILED DESCRIPTION OF THE PREFERRED EMBODIMENT

The drawing FIGURE represents a lateral view of a winding head, identified by 10, of a cheese-producing textile machine 1. Such textile machines, known as automatic cheese winders, have a plurality of winding heads 10, arranged in alignment next to one another, on which delivery bobbins 12 (hereinafter also called spinning cops) are rewound into large volume take-up bobbins 14 (hereinafter also called cheeses). In this case, the spinning cops 12 arrive at the individual winding heads 10 via a transport installation 16. As is known, the transport installation 16 includes a plurality of transport tracks, not further identified in detail, on which spinning cops 12 or empty tubes 18, which are placed on transport plates 20, are transported.

A yarn 22 is drawn off a spinning cop 12, which is in the winding position I. From the spinning cop 12, the yarn 22 passes in the yarn traveling direction 24 on its way to the cheese 14 first through a bottom yarn sensor 28, which is connected via a signal line 30 with a work station computer 32. By means of this bottom yarn sensor 28, it is determined, for example following a yarn break or a controlled cleaning cut, whether a bottom yarn 34 is even present, prior to initiating a search for the top yarn.

A yarn tensioner 36 is arranged above the bottom yarn sensor 28. The yarn tensioner 36 includes brake pads, not represented in detail, whose contact pressure which is exerted on the traveling yarn 22 can be controlled by the work station computer 32 via a signal line 38.

A yarn end connecting device 40, which for example is designed as a pneumatic splicer, is arranged outside of the regular path of the yarn. The splicing device 40 is also connected with the work station computer 32 via a signal line 42.

A yarn cleaner 44 is arranged in the following course of the yarn travel for detecting yarn faults. The quality of the traveling yarn is continuously monitored by means of the yarn cleaner 44. Signals from the yarn cleaner 44 are supplied via a signal line 48 to the work station computer 32 for evaluation. When a yarn fault appears, a cutting device 52 is actuated by the work station computer 32 via a signal line 50, and the yarn 22 is cut. A yarn tension sensor 54, as well as a paraffin application device 46 are also arranged downstream of the yarn cleaner 44 in the yarn traveling direction 24. In this case, the yarn tension sensor 54 is also connected with the work station computer 32 via a signal line 56. The yarn tension of the traveling yarn 22 is continuously monitored during regular winding operations and the yarn tensioner 36 is controlled via the work station computer 32 as a function of the signals delivered by the yarn tension sensor 54. Thus, the brake pads of the yarn tensioner 36 apply a contact pressure to the yarn 22 which assures that an essentially constant yarn tension is applied to the traveling yarn 22, which assures a uniform packing density of the finished cheese 14.

After the paraffin application device 46, a deflection device 58 follows in the yarn traveling direction, from which the yarn 22 travels onto a winding drum 60, e.g., a so-called grooved drum, which provides a traversing placement of the yarn 22 onto the bobbin 14, in accordance with the particular winding type called "random winding".

The cheese 14 is rotatably seated on a tube, not shown in detail, on a pivotably seated creel 64, and rests with its exterior circumference against the winding drum 60, which is individually driven by a motor, and which in turn drives the cheese by means of its frictional peripheral contact.

The winding head 10 furthermore contains a suction nozzle 66, as well as a gripper tube 68. In this case, the gripper tube 68 is used for grasping the bottom yarn 34 from the spinning cop 12, which in case of a controlled yarn cleaning cut or a yarn break is held above the yarn tensioner, as a rule in the yarn tensioner 36. The gripper tube 68 is pivotable around an axis of rotation 72 along the movement path 74, drawn in dashed lines, and is connected to a central vacuum supply 76 of the bobbin winding machine, which is connected with a vacuum source 78. Pivoting of the gripper tube 68 is performed by means of a drive device, known per se and therefore not shown in detail, triggered by a signal supplied by the work station computer 32.

The suction nozzle 66 is used for grasping the top yarn 80 from its disposition wound onto the cheese 14. For this purpose, the suction nozzle 66 can be pivoted around a pivot pin 82 such that its mouth 84 moves over a movement path 86. The suction nozzle 66 is also connected with the vacuum supply 76. The pivot movement of the suction nozzle 66 is triggered via the work station computer 32 by controlling a drive device, known per se and not represented, preferably a cam disk package.

The winding head 10 contains further mechanical, electrical and pneumatic components, which need not be explained in greater detail in the present description.

The winding head 10 represented in the drawings has the following functions. If the yarn 22 breaks in the course of rewinding of the spinning cop 12 from the rewinding position I onto the cheese 14 or the yarn 22 is cut by the yarn cutting device 52 as a result of an appropriate error signal from the yarn cleaner 44, the yarn tension prevailing at the yarn tension sensor 54 abruptly changes. In addition, the dynamic yarn signal provided by the yarn cleaner 44 is lacking.

Thereupon the work station computer 32 triggers the following actions. The creel 64 is immediately lifted off the winding drum 60 by means of a drive device, not represented, and in this manner the yarn end traveling onto the circumferential surface of the cheese 14 (i.e., the top yarn) is prevented from being pressed onto the cheese 14 by the winding drum 60 in such a way that it can no longer be picked up later by the suction nozzle 66. Moreover, the cheese is braked to a standstill by means of a winding brake (not represented).

In addition, the bottom yarn sensor 28 determines whether there is a bottom yarn 34.

Thus, through an appropriate signal, the bottom yarn sensor 28 immediately signals whether or not there is a bottom yarn 34 at all. If such a signal from the bottom yarn sensor 28 is missing, this indicates that either the spinning cop 12 has been exhausted, or that the bottom yarn 34 cannot be picked up by the gripper tube 68.

In either case, the yarn connecting process is interrupted by the work station computer 32 and a so-called cop changing operation is immediately triggered, i.e. the spinning cop in the winding position I or the empty cop tube is automatically exchanged for a fresh spinning cop 12.

With a positive signal from the bottom yarn sensor 28, a yarn connecting process is then started. Initially the gripper tube 68 is controlled in such a way that it mouth moves into the traveling path of the yarn 22 and grasps the bottom yarn 34. Thereafter, the gripper tube 68 is pivoted along the movement path 74, so that the grasped bottom yarn 34 is inserted into the splicing device.

The top yarn pickup is started thereafter, or simultaneously. To this end, the mouth 84 of the suction nozzle 66 is pivoted against the circumference of the cheese 14 and the winding drum 60 is driven opposite the winding direction, so that the cheese 14 is turned backward. Because of the vacuum prevailing at the mouth 84 of the suction nozzle 66, the top yarn 80 is picked up from the surface of the cheese 14 and, if required, is cleaned by a yarn cutting and sensor device (not represented) arranged inside the suction nozzle 66, i.e. the faulty yarn piece of the top yarn is cut off. Thereafter, the yarn nozzle 66 is pivoted downward along the movement path 86, so that the top yarn 80 is also inserted into the splicing device 40.

In the process, the top yarn 80 is brought into contact with the yarn tension sensor 54 by the suction nozzle 66, and is also threaded into the yarn cleaner 44. Subsequently the splicing device 40 is actuated via the control line 42 to twist the bottom yarn 34 together with the top yarn 80.

Thereafter, the creel 64 is lowered again via the work station computer 32, so that the cheese 14 comes into contact with the winding drum 60. In this manner, the winding process of the yarn 22 is continued. The yarn tension thereby created is immediately detected by the yarn tension sensor 54 and appropriate signals are forwarded through the signal line 56 to the work station computer 32. The signals provided by the yarn tension sensor 54 are continuously compared in the work station computer 32 with a preset value stored in the memory unit 90 which represents a threshold value predetermined as a maximum tension value which should be permissible for a yarn which is not hooked or looped or will otherwise be problematic to resume winding. This preset value of the yarn tension can be predetermined either for each winding head 10 or for all winding heads 10 of a bobbin winding machine 1. The set value can be a function of a quality characteristic, material strength, type of material or the like of the yarn 22 to be wound. This preset value can either be permanently stored in the memory element 90, for example for various yarns 22, or it is centrally preset by means of a central computer unit 94, which is connected with the work station computer 32 by means of a machine bus 92 as schematically indicated. The work station computer 32 includes a comparator 96, which compares the predetermined set value with the actual signal which is supplied by the yarn tension sensor 54 immediately following the restart of the winding process. If the detected actual value exceeds the predetermined threshold value, which precedes a subsequent yarn break, this is automatically interpreted by the work station computer 32 as an error which cannot be repaired, for example hookformation of the yarn 22 at the spinning cop 12, a loop or like problem.

In this case, the work station computer 32 prevents further connecting attempts, which are useless from the start, and immediately initiates a delivery bobbin change. An exchange of the respective spinning cop 12 can be immediately initiated because of the direct detection of a yarn break which cannot be repaired, at least not automatically, for example caused by hooking or looping of the yarn 22 on the spinning cop 12. A following spinning cop 12, which is made available by the transport installation 16, therefore can be immediately transferred into the unwinding position, and its bottom yarn 34 can be connected with the top yarn 80 in a known manner.

As a whole, the method of the present invention not only leads to an improvement in the efficiency of the individual winding heads 10 of the bobbin winding machine 1, and thus to an increase in productivity of the textile machine, but also to an increase in the quality of the cheeses because of the overall lower stress of the cheese surfaces.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents therein.

What is claimed is:

1. A method for operating a work station of a bobbin winding machine having a yarn tension sensor connected to a control device for monitoring the yarn tension of a yarn running from a delivery bobbin to a take-up bobbin, a yarn tensioner for regulating the yarn tension, a splicing device for the automatic connection of a first yarn end of the delivery bobbin with a second yarn end of the take-up bobbin following a yarn break or a yarn cleaning cut, and a delivery bobbin exchange device for exchanging delivery bobbins which cannot be further unwound, the method comprising the steps of monitoring an actual value of the yarn tension by means of the yarn tension sensor after connecting the first yarn end with the second yarn end, and actuating the delivery bobbin changing device by the control device to replace an existing delivery bobbin with a fresh delivery bobbin if the actual value of the yarn tension exceeds a predeterminable threshold tension value.

2. The method in accordance with claim 1, characterized in that the control device comprises a computer associated with the work station, and characterized further by comparing the actual value of the yarn tension determined by the yarn tension sensor with the predeterminable threshold tension value in the control device of the work station.

3. The method in accordance with claim 2, characterized in that the predeterminable threshold tension value is stored in a memory unit of the work station computer.

4. The method in accordance with claim 2, characterized in that the comparing of the actual tension value with the predeterminable threshold tension value is performed by a comparator in the work station computer.

5. The method in accordance with claim 1, characterized in that the predeterminable threshold tension value is predetermined individually for each of plural work stations of the bobbin winding machine.

6. The method in accordance with claim 1, characterized in that the predeterminable threshold tension value is predetermined uniformly for a plurality of work stations of the bobbin winding machine.

7. The method in accordance with claim 1, characterized in that the predeterminable threshold tension value is predetermined as a function of a property of the yarn to be processed.

8. The method in accordance with claim 1, wherein predeterminable threshold tension values for different yarns are permanently stored in the control device.

9. The method in accordance with claim 1, wherein predeterminable threshold tension values for different yarns are stored in a central computer unit connected with the control device by means of a bus.

10. The method in accordance with claim 1, characterized in that the comparing of a plurality of actual yarn tension values respectively at a plurality of work stations of the winding machine with a predeterminable threshold tension value set for all of the work stations in common is performed by a central computer unit for all work stations.

11. The method in accordance with claim 1, wherein the predeterminable threshold tension value can be changed during the operation of the work station as a function of operational parameters of the work station.

* * * * *